US009823610B2

(12) United States Patent
Kai et al.

(10) Patent No.: US 9,823,610 B2
(45) Date of Patent: Nov. 21, 2017

(54) IMAGE FORMING APPARATUS

(71) Applicant: CANON KABUSHIKI KAISHA, Tokyo (JP)

(72) Inventors: Teruhito Kai, Kashiwa (JP); Shinnosuke Iwadate, Toride (JP); Hiroto Nishihara, Tsukuba (JP); Hiromi Shimura, Toride (JP); Keita Takahashi, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/254,081

(22) Filed: Sep. 1, 2016

(65) Prior Publication Data

US 2017/0068197 A1 Mar. 9, 2017

(30) Foreign Application Priority Data

Sep. 8, 2015 (JP) ..... 2015-176703

(51) Int. Cl.
*G03G 15/00* (2006.01)

(52) U.S. Cl.
CPC ..... *G03G 15/5062* (2013.01)

(58) Field of Classification Search
CPC ..... G03G 15/5062; B65H 1/28; B65H 1/30; B65H 2404/733; B65H 2405/331; B65H 2405/351; B65H 2405/3311
See application file for complete search history.

(56) References Cited

U.S. PATENT DOCUMENTS

| | | | | |
|---|---|---|---|---|
| 4,796,035 | A | 1/1989 | Kawasaki et al. | |
| 5,290,024 | A | 3/1994 | Takahashi | |
| 5,909,872 | A | 6/1999 | Takahashi | |
| 6,311,039 | B1 | 10/2001 | Funamizu et al. | |
| 6,397,035 | B2 | 5/2002 | Kataoka et al. | |
| 6,782,236 | B2 | 8/2004 | Sasaki et al. | |
| 7,050,751 | B2 | 5/2006 | Watanabe et al. | |
| 8,398,069 | B2 * | 3/2013 | Chae | B65H 1/266 271/164 |
| 8,561,978 | B2 | 10/2013 | Takahashi et al. | |
| 8,585,037 | B1 * | 11/2013 | Jacobs | B65H 1/28 271/157 |

(Continued)

FOREIGN PATENT DOCUMENTS

| | | | |
|---|---|---|---|
| JP | 02225221 A | * | 9/1990 |
| JP | 03056334 A | * | 3/1991 |
| JP | 2625024 B2 | | 6/1997 |

*Primary Examiner* — Francis Gray
(74) *Attorney, Agent, or Firm* — Fitzpatrick, Cella, Harper & Scinto

(57) ABSTRACT

An image forming apparatus includes: a cassette including a first and a second sheet storage areas, arranged side by side, each on which a sheet having a predetermined size is placeable; a sheet feeder configured to feed the sheet from the first area to an image forming portion; a first sheet sensor; a second sheet sensor; a movement member configured to move the sheet from the second area to the first area when no sheet placed on the first area is detected by the first sheet sensor and the sheet placed on the second area is detected by the second sheet sensor; and an annunciator configured to annunciate that a sheet having a size different from the predetermined size is placed on the cassette when the first sheet sensor does not detect the sheet after a completion of a movement of the sheet.

7 Claims, 10 Drawing Sheets

(56) References Cited

U.S. PATENT DOCUMENTS

| | | | | |
|---|---|---|---|---|
| 2015/0130124 | A1* | 5/2015 | Muto | B65H 7/04<br>271/9.03 |
| 2016/0306312 | A1* | 10/2016 | Miyake | G03G 15/657 |
| 2017/0066611 | A1* | 3/2017 | Nishihara | B65H 7/04 |

* cited by examiner

IMAGE FORMING APPARATUS

BACKGROUND OF THE INVENTION

Field of the Invention

The present invention relates to an image forming apparatus including a cassette on which sheets are to be placed.

Description of the Related Art

Hitherto, a sheet feeding device is arranged in an image forming apparatus such as a copying machine or a printer. In order to increase convenience when image formation is continuously performed on a large number of sheets, a large number of predetermined-size sheets are placed on a cassette (deck) of the sheet feeding device, and the sheets are fed by a separating/feeding mechanism to an image forming portion one by one. The sheet feeding device is required to have as large a sheet capacity as possible in order to reduce the number of times that a user supplies sheets. However, it is necessary to stack the sheets vertically in order to feed the sheets by the separating/feeding mechanism. Accordingly, when a large number of sheets are stacked, a height of a sheet bundle is increased, with the result that the sheet feeding device itself is increased in size. Further, in order to continuously supply the sheets to the separating/feeding mechanism, it is necessary that a sheet placing table be gradually and vertically raised so that an upper surface of the sheet bundle is held in contact with the separating/feeding mechanism. Therefore, increase in sheet stacking amount leads to increase in size of a mechanism of the sheet placing table to be operated. In view of this, in Japanese Patent No. 2625024, there is proposed a sheet feeding device (so-called tandem sheet feeding device) capable of achieving reduction in load on the sheet placing table and reduction in height of the sheet feeding device in such a manner that a supplemental sheet placing portion is arranged next to the sheet placing table. When sheets on the sheet placing table are used up, sheets on the supplemental sheet placing portion are automatically moved onto the sheet placing table, thereby being capable of feeding the sheets continuously without interrupting image forming operation.

In Japanese Patent No. 2625024, a sheet sensor configured to detect existence or nonexistence of the sheets is arranged on each of the sheet placing table and the supplemental sheet placing portion. When the sheet sensor on the sheet placing table detects "out of sheet", a message of "out of sheet" is displayed on a display portion. When the sheet sensor on the supplemental sheet placing portion detects "out of sheet", a message of "supply sheet" is displayed on the display portion. In consideration of a main body size and the like, a sheet size capable of being placed on the tandem sheet feeding device including the supplemental sheet placing portion is limited to a predetermined size (A4 size or letter size).

However, when the sheets are moved from the supplemental sheet placing portion to the sheet placing table after the user mistakenly places sheets having a size (for example, a B5 size) smaller than the predetermined size on the supplemental sheet placing portion, the sheet sensor on the sheet placing table cannot detect "existence of sheet". Accordingly, the message of "out of sheet" is displayed on the display portion. In this case, when the predetermined-size sheets are placed on the sheet feeding device, although the sheet feeding device can be used normally, the user may misunderstand that a malfunction occurs in the sheet feeding device, and stop use of the sheet feeding device. Meanwhile, also when the sheets are not normally moved from the supplemental sheet placing portion to the sheet placing table though the predetermined-size sheets are properly placed on the supplemental sheet placing portion, the user cannot specify a cause of an abnormality. Accordingly, even under a situation in which the sheet feeding device breaks, the user may repeatedly place the predetermined-size sheets.

SUMMARY OF THE INVENTION

Therefore, the present invention provides an image forming apparatus configured to annunciate that a sheet having a size different from a predetermined size is placed on a cassette.

In order to solve the above-mentioned problem, according to one embodiment of the present invention, there is provided an image forming apparatus, comprising:

a cassette comprising a first sheet storage area and a second sheet storage area, arranged side by side, each on which a sheet having a predetermined size is placeable;

an image forming portion configured to form an image on the sheet;

a sheet feeder configured to feed the sheet placed on the first sheet storage area of the cassette to the image forming portion;

a first sheet sensor configured to detect the sheet placed on the first sheet storage area;

a second sheet sensor configured to detect the sheet placed on the second sheet storage area;

a movement member configured to move the sheet from the second sheet storage area to the first sheet storage area when the sheet is not detected by the first sheet sensor and the sheet is detected by the second sheet sensor; and an annunciator configured to annunciate that a sheet having a size different from the predetermined size is placed on the cassette in a case where the first sheet sensor does not detect the sheet on the first sheet storage area after a completion of a movement operation of the sheet from the second sheet storage area to the first sheet storage area by the movement member.

Further features of the present invention will become apparent from the following description of exemplary embodiments with reference to the attached drawings.

DESCRIPTION OF THE EMBODIMENTS

Now, an embodiment of the present invention will be described with reference to the attached drawings.

<Image Forming System>

Figure 1:
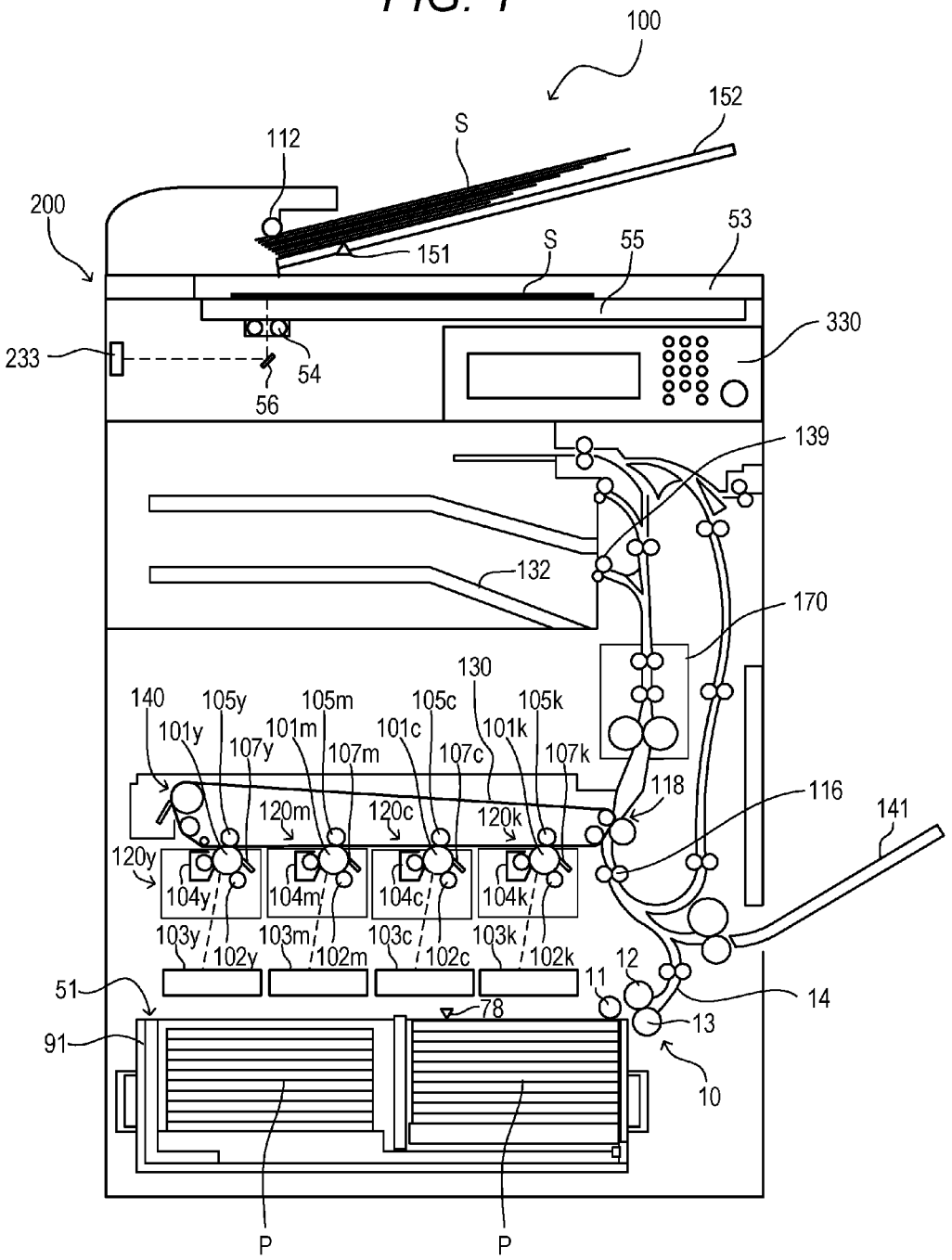
FIG. 1 is a sectional view of an image forming apparatus.
Figure 2:
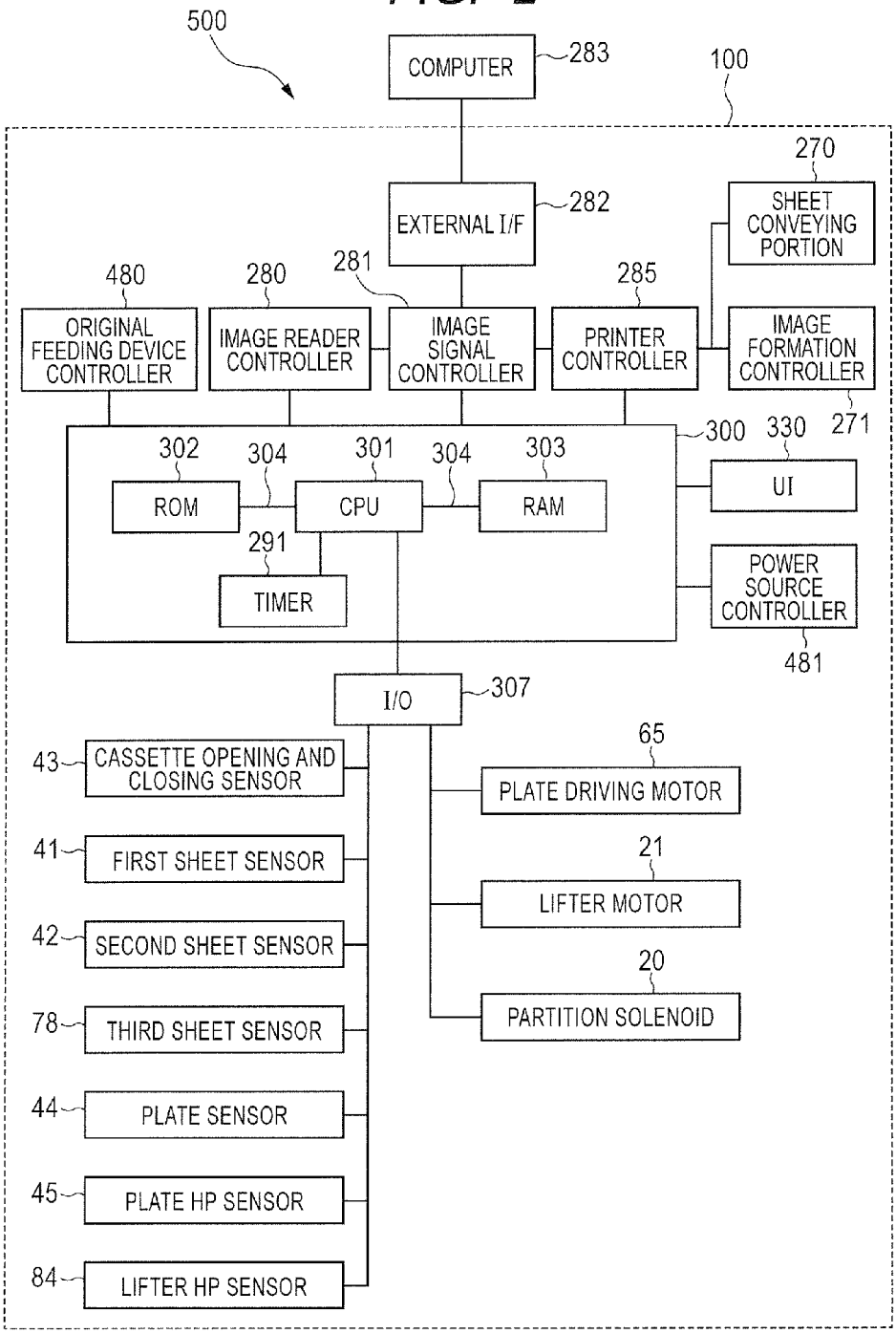
FIG. 2 is a block diagram of an image forming system.

An image forming system 500 includes an image forming apparatus 100 and a computer 283. FIG. 1 is a sectional view of the image forming apparatus 100. FIG. 2 is a block diagram of the image forming system 500. With reference to FIG. 1 and FIG. 2, the image forming apparatus 100 will be described.

[Image Forming Apparatus]

An original reading portion 200 is arranged in an upper portion of the image forming apparatus 100. The original reading portion 200 includes an original tray 152, an original sensor 151, an original conveying roller 112, and an original feeding device controller 480. The original reading portion 200 further includes an original table glass (hereinafter referred to as platen glass) 55, a lamp (light source) 54, a reflection mirror 56, an image sensor 233, and an image reader controller 280. The original reading portion 200 includes an original pressure plate 53 configured to press an original S placed on the platen glass 55 in order to read the original.

As illustrated in FIG. 2, the image forming apparatus 100 includes a controller 300. The controller 300 performs system control on the image forming apparatus 100. The controller 300 includes a central processing unit (CPU) (control circuit) 301, a read only memory (ROM) (memory portion) 302, a random access memory (RAM) (memory portion) 303, and a timer (timing portion) 291.

The CPU 301 is a central processing unit configured to perform system control on the image forming apparatus 100. The CPU 301 is connected to each of the ROM 302 and the RAM 303 through buses 304 such as an address bus and a data bus. The ROM 302 stores a control program. The RAM 303 stores a variable "t" to be used for the control and image data to be read by the image sensor 233. The RAM 303 is a nonvolatile memory configured to hold stored values even when power supply to the image forming apparatus 100 is stopped. The CPU 301 is connected to the timer 291. The timer 291 can keep count of (measure) an amount of time, and output a time count value to the CPU 301. The CPU 301 can set a measurement time for the timer 291 to keep count. In the embodiment, the timer 291 counts up the variable "t" (internal counter) stored in the RAM 303. The variable "t" indicates an elapsed time period.

The CPU 301 is electrically connected to a cassette opening and closing sensor 43, a first sheet sensor 41, a second sheet sensor 42, and a third sheet sensor 78 through an I/O 307. Further, the CPU 301 is electrically connected to a bundle movement regulating plate end portion sensor (hereinafter referred to as plate sensor) 44, a bundle movement regulating plate HP sensor (hereinafter referred to as plate HP sensor) 45, and a lifter HP sensor 84 through the I/O 307. Detection signals of the sensors are input to the CPU 301. The CPU 301 is electrically connected to a partition solenoid 20, a lifter motor 21, and a bundle movement regulating plate driving motor (hereinafter referred to as plate driving motor) 65 through the I/O 307. The CPU 301 controls the partition solenoid 20, the lifter motor 21, and the plate driving motor 65.

Via the original feeding device controller 480, the CPU 301 drives the original conveying roller 112, and detects presence or absence of the originals S on the original tray 152 by the original sensor 151, which are illustrated in FIG. 1. Further, via the image reader controller 280, the CPU 301 detects opening and closing operation of the original pressure plate 53, and reads an image of the original S on the platen glass 55 by the image sensor 233. The original reading portion 200 can perform fixed-reading for the image of the original S placed on the platen glass 55 and flow-reading for the images of the originals S conveyed from the original tray 152 to the platen glass 55 by the original conveying roller 112. An analog image signal output from the image sensor 233 is transferred to an image signal controller 281.

During copying operation, after converting the analog image signal from the image sensor 233 into a digital image signal, the image signal controller 281 performs various kinds of processing on the digital image signal, and then converts the digital image signal into a video signal so as to output the video signal to a printer controller 285. Further, during printing operation, the image signal controller 281 performs various kinds of processing on a digital image signal input from a computer 283 through an external I/F 282, and then converts the digital image signal into a video signal so as to output the video signal to the printer controller 285. Based on an instruction from the CPU 301, the printer controller 285 instructs an image forming controller 271 to form an image. Based on the video signal from the printer controller 285, the image forming controller 271 drives an image forming portion 120. Further, based on an instruction from the CPU 301, the printer controller 285 controls a sheet feeder 270 so as to cause the sheet feeder 270 to feed and convey a recording medium (hereinafter referred to as sheet) P. Further, based on an instruction from the CPU 301, the printer controller 285 drives a fixing device 170, and performs fixing control so as to cause the fixing device 170 to fix a toner image formed on the sheet P to the sheet P.

A user interface (hereinafter referred to as UI) 330 is an operating portion for a user to operate the image forming apparatus 100. The user sets image forming conditions through the UI 330. The image forming conditions include a plurality of color modes such as a monochrome mode for forming a monochrome image, a full-color mode for forming a full-color image, and a full-color/monochrome automatically discriminating mode. Further, the image forming conditions include an enlargement/reduction factor, sheet selection, image density setting, simplex or duplex printing, the number of copies, and the like. Through the UI 330, the user can set (select) the color mode for performing the image formation and instruct to start copying. The CPU 301 stores the color mode set through the UI 330 in the RAM 303. The UI 330 can also display a state of the image forming apparatus 100.

When image forming operation (copying operation or printing operation) is not performed for a predetermined time period, the CPU 301 is switched from a standby mode (normal state) to a power saving mode (sleep state) through a power source controller 481. In the power saving mode, the CPU 301 turns off an LED backlight of the UI 330, and stops power supply to various kinds of driving loads.

[Image Forming Operation]

Next, image forming operation of the image forming apparatus 100 will be described with reference to FIG. 1 and FIG. 2. The CPU 301 performs image forming preparing operation when detecting print setting instructions from the UI 330 as to a color mode, the input number of documents to be printed, and the like, and detecting opening and closing operation of the original pressure plate 53 and placement of the original S on the platen glass 55 through the original feeding device controller 480 and the image reader controller 280. In the image forming preparing operation, the CPU 301 controls temperature adjustment of the fixing device 170, switches an intermediate transfer unit 140 between an abutment state and a separation state in accordance with the color mode designated by the UI 330, and starts driving control on a motor of a light scanning device 103.

When receiving an instruction to start the copying operation, through the original feeding device controller 480, the CPU 301 causes the original reading portion 200 to start reading an image of the original S. The CPU 301 drives the original conveying roller 112 to cause the original conveying roller 112 to convey the original S from the original tray 152 onto the platen glass 55, and cause the lamp 54 to radiate light to the original on the platen glass 55. Reflected light from the original is led to the image sensor 233 by the reflection mirror 56. Image data of the original S read by the image sensor 233 is output to the image signal controller 281. The image data is stored in the RAM 303 of the controller 300. Original reading operation is continued until reading of the original S on the platen glass 55 is completed, or until reading of a last original detected by the original sensor 151 is completed.

After completion of switching the intermediate transfer unit 140 between the abutment state and the separation state, the CPU 301 controls image forming portions 120*y*, 120*m*, 120*c*, and 120*k* through the image forming controller 271. The CPU 301 executes the image forming operation in accordance with the image data stored in the RAM 303. Note that, suffixes y, m, c, and k of reference symbols respectively represent components corresponding to yellow, magenta, cyan, and black. The image forming portion 120*y* forms a yellow toner image. The image forming portion 120*m* forms a magenta toner image. The image forming portion 120*c* forms a cyan toner image. The image forming portion 120*k* forms a black toner image. The image forming portions 120*y*, 120*m*, 120*c*, and 120*k* have the same structure except for toner colors. Accordingly, in the following description, the suffixes y, m, c, and k of reference symbols are omitted.

The image forming portion 120 includes a photosensitive drum (photosensitive member) 101, a developing device 104, a charging roller 102, and a photosensitive drum cleaner 107. The charging roller (charging member) 102 uniformly charges a surface of the photosensitive drum 101. The light scanning device (exposure device) 103 emits a laser beam (light beam), which is modulated in accordance with the image data, to the uniformly charged surface of the photosensitive drum 101, thereby forming an electrostatic latent image on the photosensitive drum 101. The developing device 104 develops the electrostatic latent image on the photosensitive drum 101 with toners of the respective colors, thereby forming toner images of the respective colors. A primary transfer roller 105, to which a primary transfer voltage is applied, sequentially transfers and superposes the toner image on the photosensitive drum 101 onto an intermediate transfer belt 130. The toner image transferred onto the intermediate transfer belt 130 is brought to a secondary transfer portion 118 due to rotation of the intermediate transfer belt 130.

Through the sheet feeder 270, the CPU 301 drives motors (not shown) serving as driving sources for a pickup roller 11, a feed roller 12, registration rollers 116, and discharge rollers 139. The pickup roller 11 feeds the sheets P from a cassette 91 toward the registration rollers 116 one by one. The registration rollers 116 convey each sheet P to the secondary transfer portion 118 in accordance with timing of the toner image on the intermediate transfer belt 130. At the secondary transfer portion 118 to which a secondary transfer voltage is applied, the toner image on the intermediate transfer belt 130 is transferred onto the sheet P.

The sheet P on which the toner image has been transferred is conveyed to the fixing device 170. The fixing device 170 heats and applies pressure to the sheet P, thereby fixing the toner image onto the sheet P. In this manner, an image is formed on the sheet P. The CPU 301 drives the discharge rollers 139 through the sheet feeder 270 to cause the discharge rollers 139 to discharge the sheet P, on which the image has been formed, onto a discharge tray 132.

The image forming apparatus 100 and the image forming operation described above are merely an example. The present invention is not limited to the image forming apparatus 100 and the image forming operation described above.

[Sheet Feeding Device]

Figure 3A:
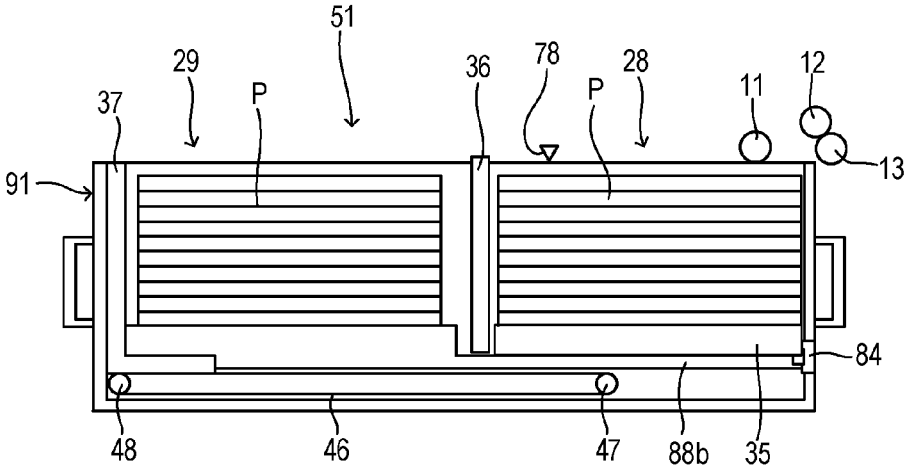
FIGS. 3A, 3B and 3C are sectional views of a sheet feeding device.
Figure 3B:
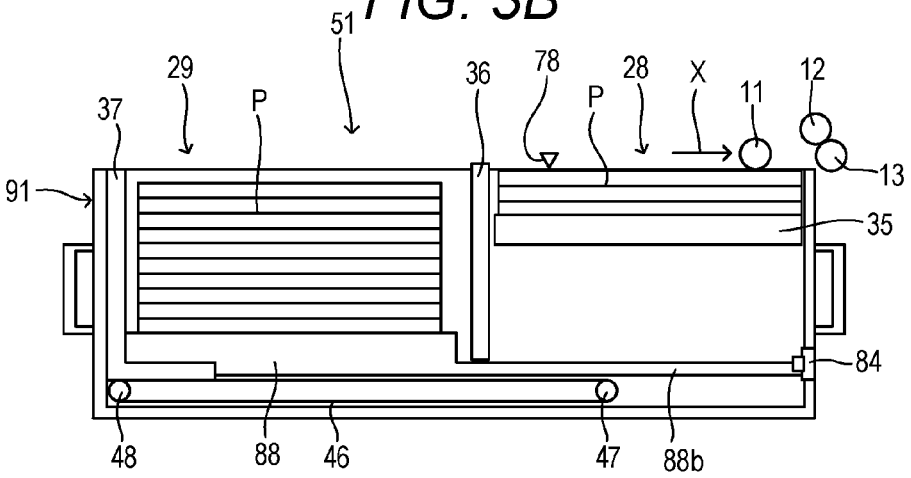
Figure 3C:
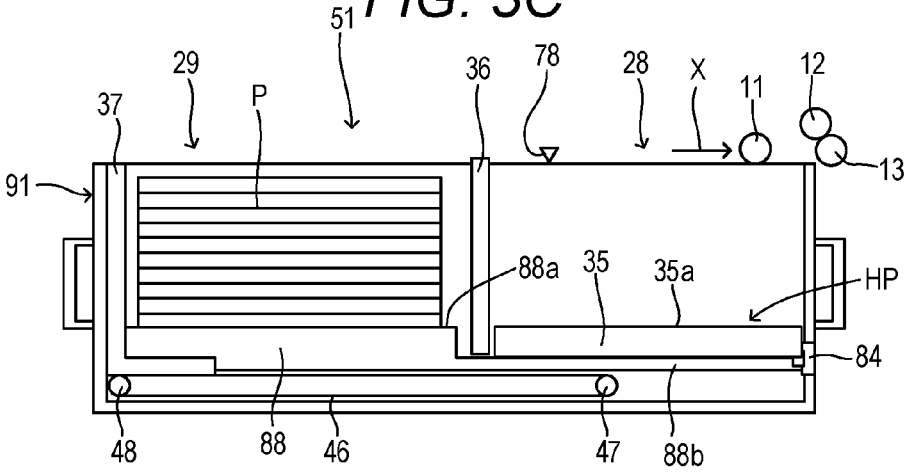

Next, a sheet feeding device (sheet feeding unit) 51 according to the embodiment will be described with reference to FIG. 3A, FIG. 3B, and FIG. 3C. FIG. 3A, FIG. 3B, and FIG. 3C are sectional views of the sheet feeding device 51. The sheet feeding device 51 includes the cassette 91 on which sheet bundles P are to be placed. The cassette 91 is mounted so as to be pulled out from a main body of the image forming apparatus 100 in a direction orthogonal to a sheet feeding direction X (FIG. 3B) in which the sheet P is fed from the sheet feeding device 51 into a sheet conveyance path 14. The cassette 91 is supported by a main body (cassette supporting member) 51*a* (FIG. 5A) of the sheet feeding device 51 so as to be pulled out from the main body of the image forming apparatus 100. The cassette 91 includes a first sheet storage area 28 and a second sheet storage area 29 on which bundles of A4-size (or letter-size) sheets P are to be placed. That is, when the cassette 91 is pulled out, the first sheet storage area and the second sheet storage area 29 are pulled out integrally. The first sheet storage area 28 and the second sheet storage area 29 are arranged adjacent to each other in a horizontal direction. In the embodiment, the first sheet storage area 28 and the second sheet storage area 29 are arranged side by side in the sheet feeding direction X so as to enable two bundles of A4-size (or letter-size) sheets to be arranged side by side in the sheet feeding direction X. The sheets P are fed one by one by the pickup roller 11 from the sheet bundle P placed on the first sheet storage area 28 arranged on a downstream side in the sheet feeding direction X (on the right side in FIG. 3A, FIG. 3B, and FIG. 3C). When the sheets P placed on the first sheet storage area 28 are used up, the sheet feeding device 51 can move, to the first sheet storage area 28, all the sheet bundle P placed on the second sheet storage area 29 arranged on an upstream side in the sheet feeding direction X (on the left side in FIG. 3A, FIG. 3B, and FIG. 3C). The sheet feeding device 51 includes the cassette of a tandem type configured to continue feeding of the sheets P in such a manner that the sheet bundle P is moved from the second sheet storage area 29 to the first sheet storage area 28 without interrupting the image forming operation even when the first sheet storage area 28 is out of sheet.

Predetermined-size sheets placeable on the first sheet storage area 28 and the second sheet storage area 29 are not limited to A4-size (or letter-size) sheets, but A5-size sheets, B5-size sheets, or the like may be used. That is, it is only necessary that the first sheet storage area 28 and the second sheet storage area 29 be arranged side by side in the sheet feeding direction X so as to enable two bundles of the predetermined-size sheets to be arranged side by side in the sheet feeding direction X. Further, the first sheet storage area 28 and the second sheet storage area 29 may be arranged side by side in a direction Y (FIG. 5B) orthogonal to the sheet feeding direction X so as to enable two bundles of the predetermined-size sheets to be arranged side by side in the direction Y orthogonal to the sheet feeding direction X.

(Structure of Sheet Feeding Device)

FIG. 3A is an illustration of a state immediately after the sheet bundle P is placed on each of the first sheet storage area 28 and the second sheet storage area 29. A lifter plate 35 configured to be raised and lowered is arranged in the first sheet storage area 28. The sheet bundle P placed on the first sheet storage area 28 is lifted up and down by the lifter plate 35. The lifter plate 35 is configured to be raised and lowered by a driving force of the lifter motor 21. In FIG. 3A, the lifter plate 35 is positioned at a lowermost end in a lifting range.

FIG. 3B is a sectional view of the sheet feeding device 51 during sheet feeding operation. In order to properly feed the sheets P, an uppermost sheet P of the sheet bundle P on the lifter plate 35 needs to be always stably held in abutment on the pickup roller 11 arranged above the lifter plate 35. That is, the uppermost sheet P of the sheet bundle P placed on the first sheet storage area 28 needs to be at a proper position at which the uppermost sheet P can be fed by the pickup roller 11. The third sheet sensor 78 detects whether or not the uppermost sheet P of the sheet bundle P placed on the first sheet storage area 28 is at the proper position at which the uppermost sheet P can be fed. The CPU 301 raises the lifter plate 35 through control of drive of the lifter motor 21 until the third sheet sensor 78 detects the uppermost sheet P. During the image forming operation, the CPU 301 controls drive of the lifter motor 21 in order to adjust a height position of the lifter plate 35 in accordance with a decrement of the sheets P so that the uppermost sheet P of the sheet bundle P on the lifter plate can be always stably held in abutment on the pickup roller 11.

The pickup roller 11 is supported in a pivotable manner by an arm (not shown) which is pivotable about the feed roller 12. The pickup roller 11 draws out the uppermost sheet P in the sheet feeding direction X while being held in abutment on the uppermost sheet P of the sheet bundle P placed on the lifter plate 35. The drawn-out sheet P is fed by the feed roller 12 into the sheet conveyance path 14. In a case of overlap feeding in which two or more sheets P are fed in an overlapping state, the overlapping sheets P other than and subsequent to the uppermost sheet are returned into the cassette (sheet storage portion) 91 due to a separating action exerted by the feed roller 12 and a retard roller 13. The pickup roller 11, the feed roller 12, and the retard roller 13 construct a sheet feeder 10 configured to feed the sheet P from the cassette 91 into the sheet conveyance path 14.

FIG. 3C is a sectional view of the sheet feeding device 51 when the lifter plate 35 is lowered after the third sheet sensor 78 does not detect the sheet P during the image forming operation. Based on a detection signal of the third sheet sensor 78, the CPU 301 can determine whether or not the sheet P exists on the first sheet storage area 28. A lifter home position (HP) sensor 84 is arranged in a lower portion of a downstream end portion (right end portion in FIG. 3C) of the cassette 91 in the sheet feeding direction X. The lifter HP sensor 84 detects whether or not the lifter plate 35 is at a home position (fixed position). When the lifter plate 35 is at the home position HP, an upper surface 35*a* of the lifter plate 35 is substantially flush with an upper surface 88*a* of a set tray on the second sheet storage area 29, which will be described later. When the third sheet sensor 78 does not detect the sheet P, the CPU 301 drives the lifter motor 21 until receiving the detection signal of the lifter HP sensor 84, thereby lowering the lifter plate 35 to the home position HP.

(Sheet Bundle Movement Operation)

Figure 4A:
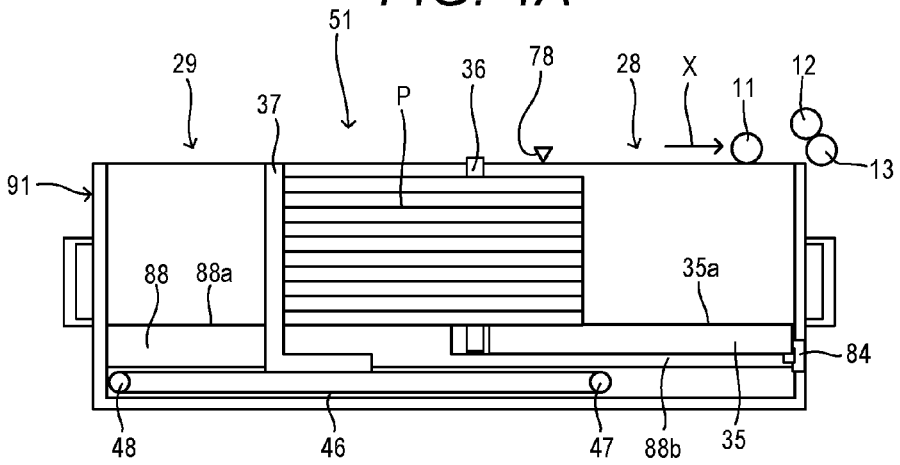
FIGS. 4A, 4B and 4C are sectional views of the sheet feeding device, for illustrating sheet bundle movement operation.
Figure 4B:
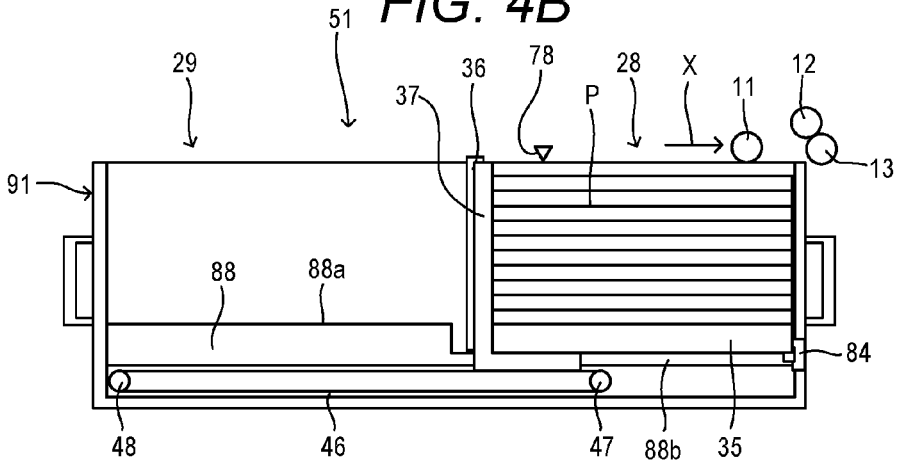
Figure 4C:
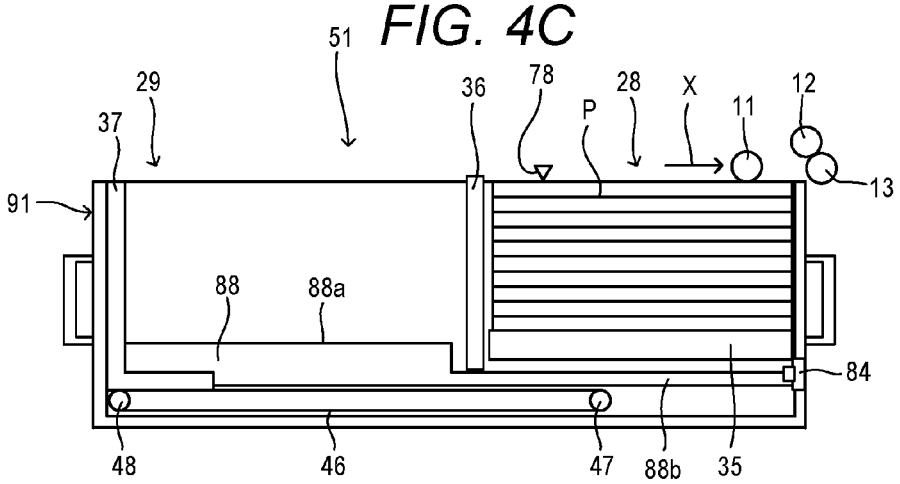
Figure 5A:
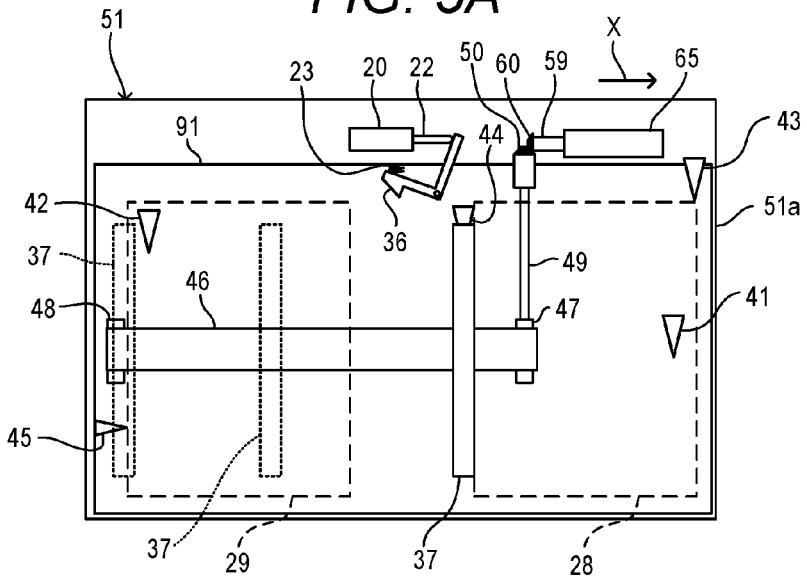
FIGS. 5A and 5B are plan views of the sheet feeding device, for illustrating the sheet bundle movement operation.
Figure 5B:
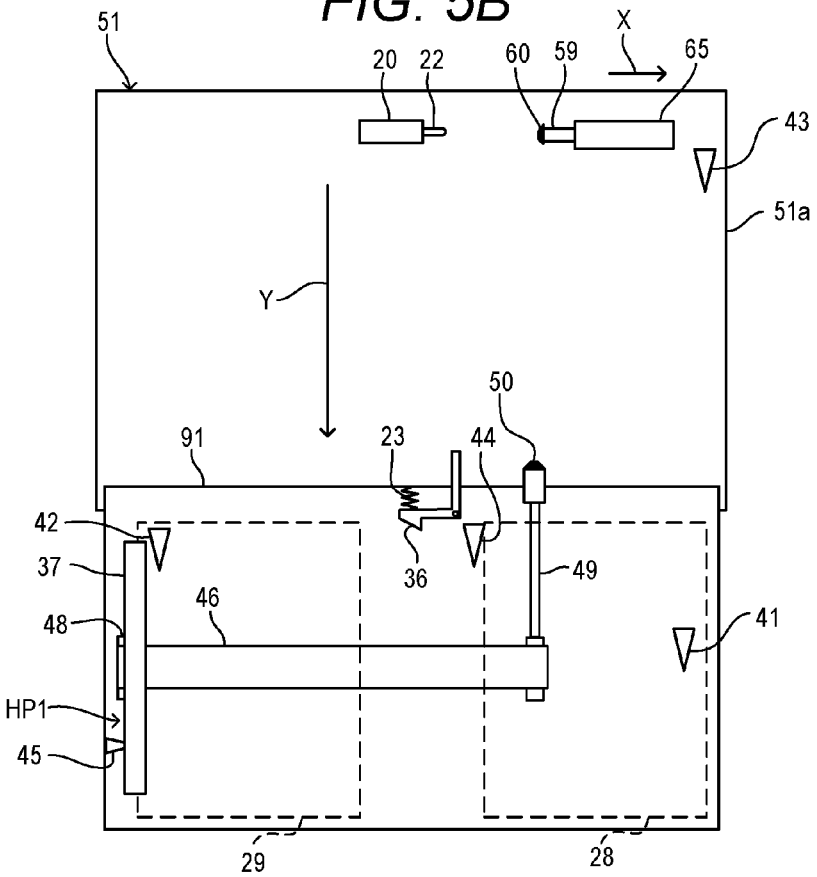

Next, sheet bundle movement operation of the sheet feeding device 51 will be described with reference to FIG. 4A, FIG. 4B, FIG. 4C, FIG. 5A, and FIG. 5B. FIG. 4A, FIG. 4B, and FIG. 4C are sectional views of the sheet feeding device 51 for illustrating the sheet bundle movement operation. FIG. 5A and FIG. 5B are plan views of the sheet feeding device 51 for illustrating the sheet bundle movement operation. FIG. 5A is a view for illustrating a state in which the cassette 91 is pushed in the sheet feeding device 51, that is, a closed state of the cassette 91. The cassette 91 is at a mounting position at which the cassette 91 is mounted in the main body of the image forming apparatus 100. FIG. 5B is a view for illustrating a state in which the cassette 91 is pulled out from the sheet feeding device 51 in the direction Y orthogonal to the sheet feeding direction X, that is, an open state of the cassette 91. The cassette 91 is at a pullout position at which the cassette 91 is pulled out from the main body of the image forming apparatus 100. The cassette 91 is supported by the sheet feeding device 51 so as to be movable between the mounting position and the pullout position.

As illustrated in FIG. 4A, FIG. 4B, and FIG. 4C, the sheet feeding device 51 includes the stationary set tray 88 arranged on a bottom portion of the second sheet storage area 29. A part 88*b* of the stationary set tray 88 extends into the first sheet storage area 28. In the second sheet storage area 29, there is arranged a bundle movement regulating plate (movement member) 37 supported so as to be slidable and movable between an upstream end portion of the second sheet storage area 29 and an upstream end portion of the first sheet storage area 28 along the set tray 88 in the sheet feeding direction X. The bundle movement regulating plate 37 is fixed to an endless bundle movement regulating plate driving belt 46. The bundle movement regulating plate driving belt 46 is stretched over a drive roller 47 and a driven roller 48. The drive roller 47 is connected to a bevel gear 50 through intermediation of a shaft 49. The bevel gear 50 can mesh with a bevel gear 60 fixed to a shaft 59 of the plate driving motor 65. The plate driving motor 65 can rotate forwardly and reversely. A driving force of the plate driving motor 65 is transmitted to the drive roller 47 through the shaft 59, the bevel gears 60 and 50, and the shaft 49. Forward rotation and reverse rotation of the drive roller 47 cause the bundle movement regulating plate driving belt 46 to rotate to move the bundle movement regulating plate 37 in the sheet feeding direction X and in a direction opposite to the sheet feeding direction X, respectively. Due to rotation of the bundle movement regulating plate driving belt 46, the bundle movement regulating plate 37 is slidable and movable in the sheet feeding direction X and in the direction opposite to the sheet feeding direction X. The plate driving motor 65 is controlled by the CPU 301 of the controller 300. The bundle movement regulating plate 37 is configured to push the sheet bundle P in the sheet feeding direction X while being held in abutment on an upstream end portion of the sheet bundle P placed on the second sheet storage area 29. All the sheet bundle P placed on the second sheet storage area 29 is slid and moved to the first sheet storage area 28 by the bundle movement regulating plate 37. The bundle movement regulating plate 37, the bundle movement regulating plate driving belt 46, and the plate driving motor 65 construct a sheet bundle moving device (sheet moving unit) configured to move the sheet bundle P from the second sheet storage area 29 to the first sheet storage area 28.

At a center portion of the sheet feeding device 51, there is arranged an arm member 36 configured to divide the sheet bundle P placed on the first sheet storage area and the sheet bundle P placed on the second sheet storage area 29 from each other. The arm member 36 is configured to be movable between a dividing position and an opening position through driving of the partition solenoid 20. The dividing position is a position at which the arm member 36 divides the first sheet storage area 28 and the second sheet storage area 29 from each other. The opening position is a position at which the arm member 36 retreats from the dividing position to open a space between the first sheet storage area 28 and the second sheet storage area 29. Normally, the arm member 36 is at the dividing position as a home position. As illustrated in FIG. 5A, during the sheet bundle movement operation, when the bundle movement regulating plate 37 is moved from the second sheet storage area 29 to the first sheet storage area 28, the arm member 36 is at the opening position. At the opening position, a shaft 22 of the partition solenoid 20 protrudes to retain the arm member 36 at the opening position against an urging force of a spring (elastic member) 23. As illustrated in FIG. 5B, when the cassette 91 is pulled out from the sheet feeding device 51, the arm member 36 is at the dividing position. At the dividing position, the shaft 22 of the partition solenoid 20 retracts so that the arm member 36 is retained at the dividing position by the urging force of the spring 23.

FIG. 4A is a sectional view of the sheet feeding device 51 when the sheet bundle P is moved by the bundle movement regulating plate 37 from the second sheet storage area 29 to the first sheet storage area 28. When the sheet bundle movement operation is started, as illustrated in FIG. 4A, the sheet bundle P stored on the second sheet storage area 29 is moved by the bundle movement regulating plate 37 to the first sheet storage area 28. At this time, as illustrated in FIG. 5A, the arm member 36 retreats from the dividing position to the opening position.

FIG. 4B is a sectional view of the sheet feeding device 51 when the sheet bundle movement operation to the first sheet storage area 28 is completed. As illustrated in FIG. 5A and FIG. 5B, the plate sensor (movement member sensor) 44 is mounted to the cassette 91. When the bundle movement regulating plate 37 reaches a predetermined position at which the bundle movement regulating plate 37 completes movement of the sheet bundle P to the first sheet storage area 28, the plate sensor 44 detects the bundle movement regulating plate 37 and then outputs a detection signal. That is, the plate sensor 44 outputs the detection signal indicating whether or not the bundle movement regulating plate 37 completes movement of the sheet bundle P to the predetermined position in the first sheet storage area 28. When receiving the detection signal of the plate sensor 44, the CPU 301 stops the plate driving motor 65, thereby stopping movement of the bundle movement regulating plate 37. The plate sensor 44 functions as a determination unit configured to determine whether or not movement of the sheet bundle P from the second sheet storage area 29 to the first sheet storage area 28 is completed.

FIG. 4C is a sectional view of the sheet feeding device 51 when the lifter plate 35 is raised. When movement of the sheet bundle P from the second sheet storage area 29 to the first sheet storage area 28 is completed, the CPU 301 rotates the plate driving motor 65 reversely, thereby returning the bundle movement regulating plate 37 to a home position HP1 (FIG. 5B) at an upstream end portion of the second sheet storage area 29 in the sheet feeding direction X. A plate HP sensor (movement member home position sensor) 45 (FIG. 5B) is mounted to the cassette 91. When the bundle movement regulating plate 37 reaches the home position HP1, the plate HP sensor 45 detects the bundle movement regulating plate 37 and then outputs a detection signal. That is, the plate HP sensor 45 outputs the detection signal indicating whether or not the bundle movement regulating plate 37 reaches the home position HP1. When receiving the detection signal of the plate HP sensor 45, the CPU 301 stops the plate driving motor 65, thereby stopping movement of the bundle movement regulating plate 37. The bundle movement regulating plate 37 is returned to the home position HP1 so that a space for storing a new sheet bundle P is secured in the second sheet storage area 29. The CPU 301 controls the lifter motor 21 to raise the lifter plate 35, and brings the uppermost sheet P of the sheet bundle P placed on the lifter plate 35 into abutment on the pickup roller 11. When detecting that the uppermost sheet P is at the proper position at which the uppermost sheet P can be fed, the third sheet sensor 78 outputs a detection signal. When receiving the detection signal of the third sheet sensor 78, the CPU 301 stops the lifter motor 21, thereby stopping movement of the lifter plate 35.

As illustrated in FIG. 5A and FIG. 5B, the cassette 91 integrally includes the first sheet storage area 28 and the second sheet storage area 29. The cassette 91 is supported by a guide member (not shown) so as to be mounted to and pulled out from a mounting portion inside the main body 51*a* of the sheet feeding device 51. The second sheet sensor 42 is arranged on a bottom surface (upper surface 88*a* of the set tray 88 in the embodiment) which is a sheet placement surface of the second sheet storage area 29. The second sheet sensor 42 is arranged on a far side of an upstream end portion of the second sheet storage area 29 in the sheet feeding direction X. The second sheet sensor 42 detects whether or not the sheet P is placed on the second sheet storage area 29. The first sheet sensor 41 is arranged on a bottom surface (upper surface 35*a* of the lifter plate 35 in the embodiment) which is a sheet placement surface of the first sheet storage area 28. The first sheet sensor 41 is arranged at a center portion of a downstream end portion of the first sheet storage area 28 in the sheet feeding direction X. The first sheet sensor 41 detects whether or not the sheet P is placed on the first sheet storage area 28. The first sheet sensor 41 is arranged at a position non-overlapping the second sheet sensor 42 in the direction Y orthogonal to the sheet feeding direction X. Further, the first sheet sensor is arranged at a position non-overlapping the third sheet sensor 78 in a vertical direction. The plate HP sensor 45 and the plate sensor 44 are mounted to the cassette 91. Based on detection signals of the plate HP sensor 45 and the plate sensor 44, the CPU 301 controls sliding movement of the bundle movement regulating plate 37 in the sheet feeding direction X and the direction opposite to the sheet feeding direction X.

The cassette opening and closing sensor 43 is mounted to the main body 51*a* of the sheet feeding device 51. The cassette opening and closing sensor 43 detects whether or not the cassette 91 is mounted to the mounting portion of the main body 51*a* of the sheet feeding device 51. That is, the cassette opening and closing sensor 43 detects whether or not the cassette 91 is closed.

(Sheet Bundle Movement Controlling Operation)

Figure 6:
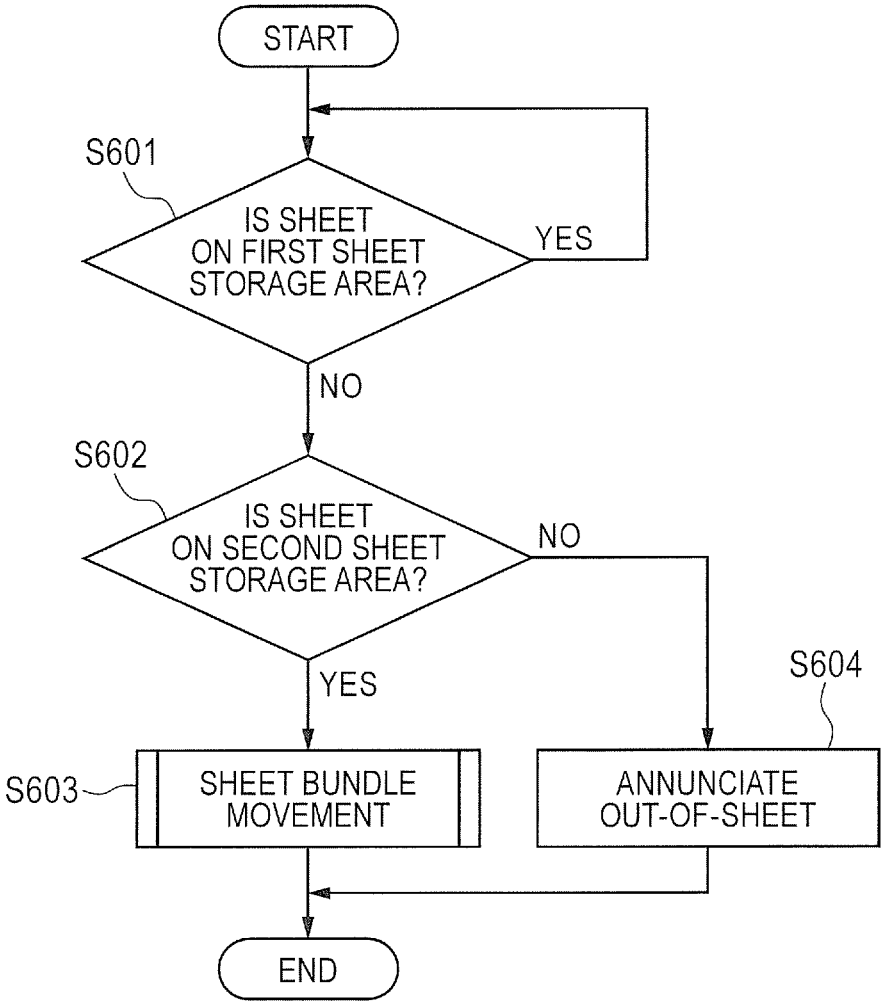
FIG. 6 is a flow chart for illustrating sheet bundle movement controlling operation during image forming operation.
Figure 7:
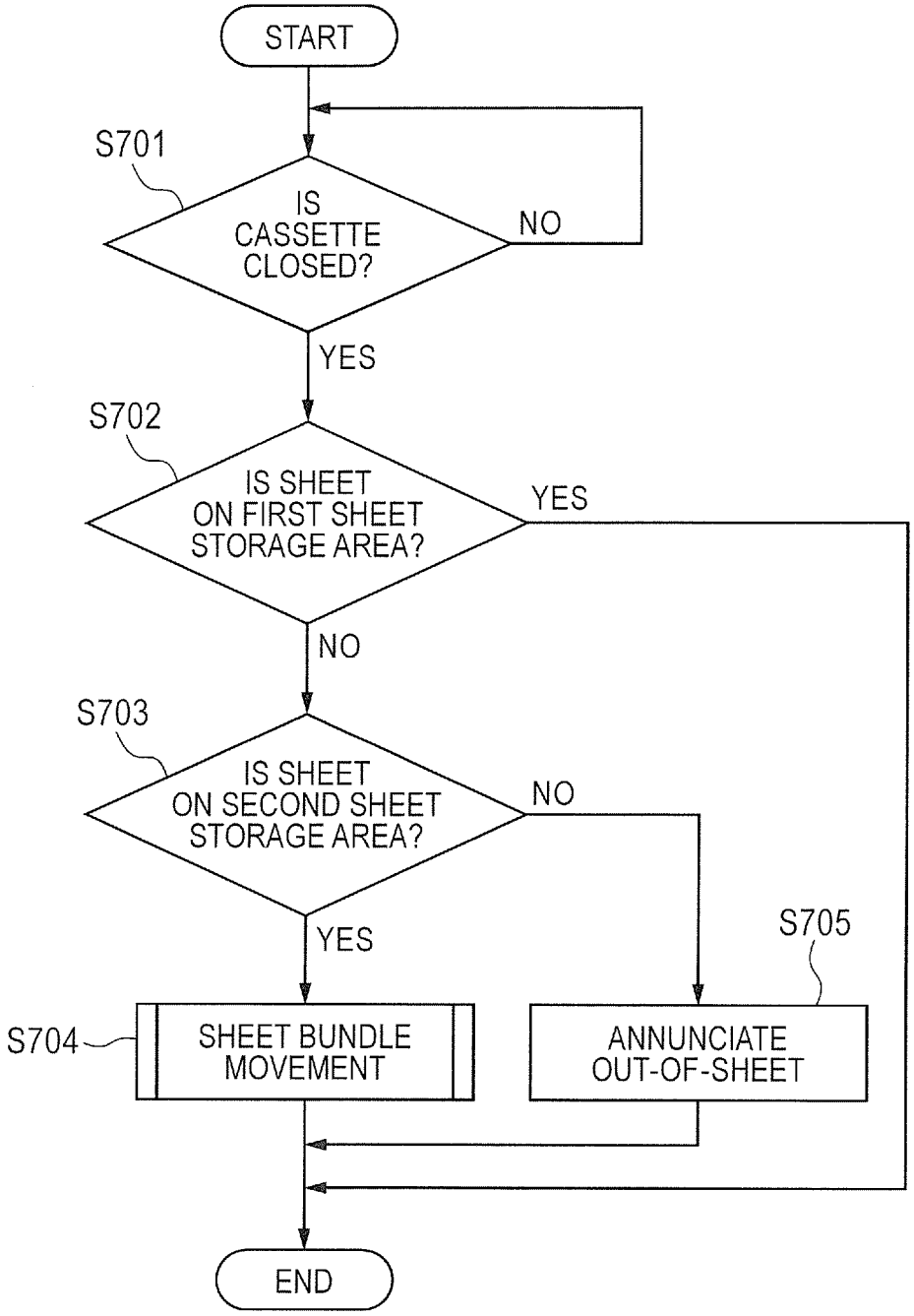
FIG. 7 is a flow chart for illustrating the sheet bundle movement controlling operation when a cassette is closed.
Figure 8:
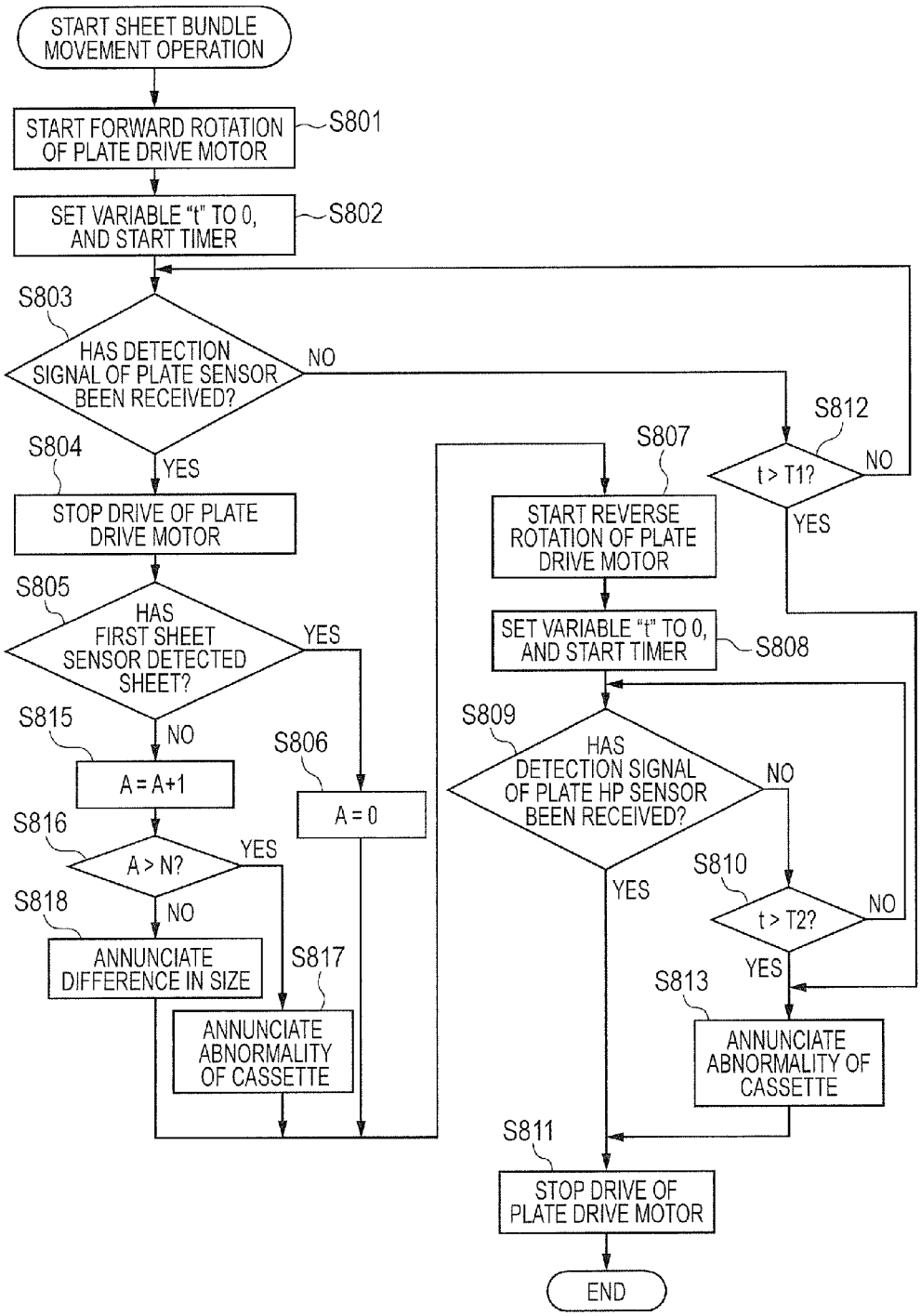
FIG. 8 is a flow chart for illustrating subroutines of the sheet bundle movement operation.
Figure 9A:
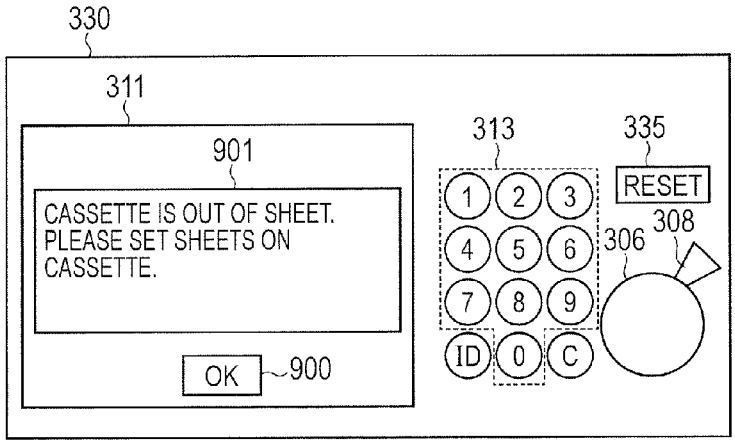
FIGS. 9A, 9B and 9C are views for illustrating a screen displayed on a display portion of a user interface (UI).
Figure 9B:
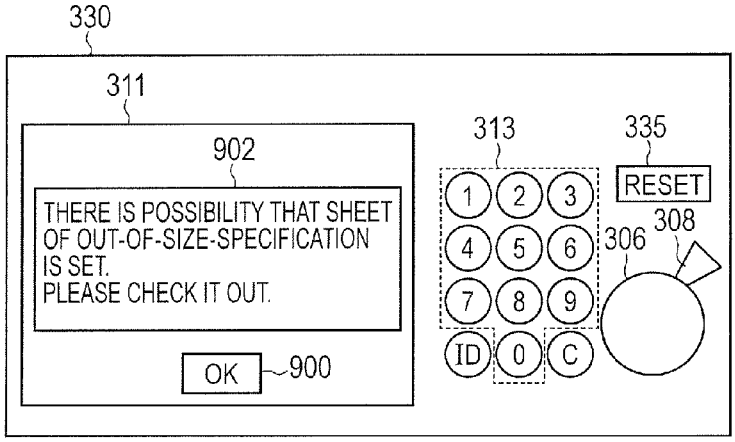
Figure 9C:
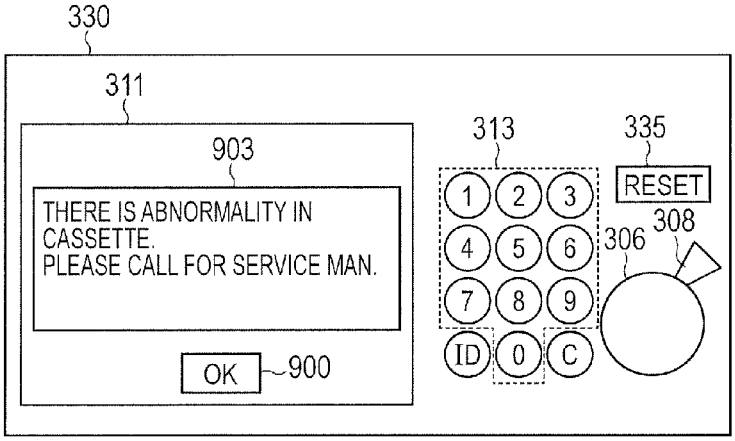
Figure 10A:
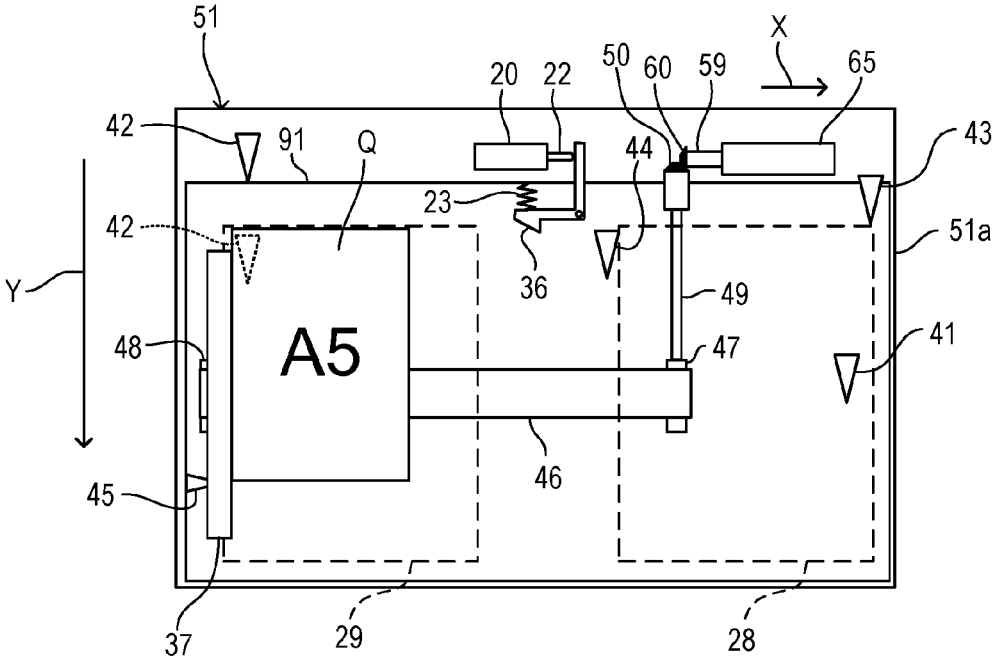
FIGS. 10A and 10B are explanatory views for illustrating a use case where an A5-size sheet different from a predetermined A4-size sheet is placed.
Figure 10B:
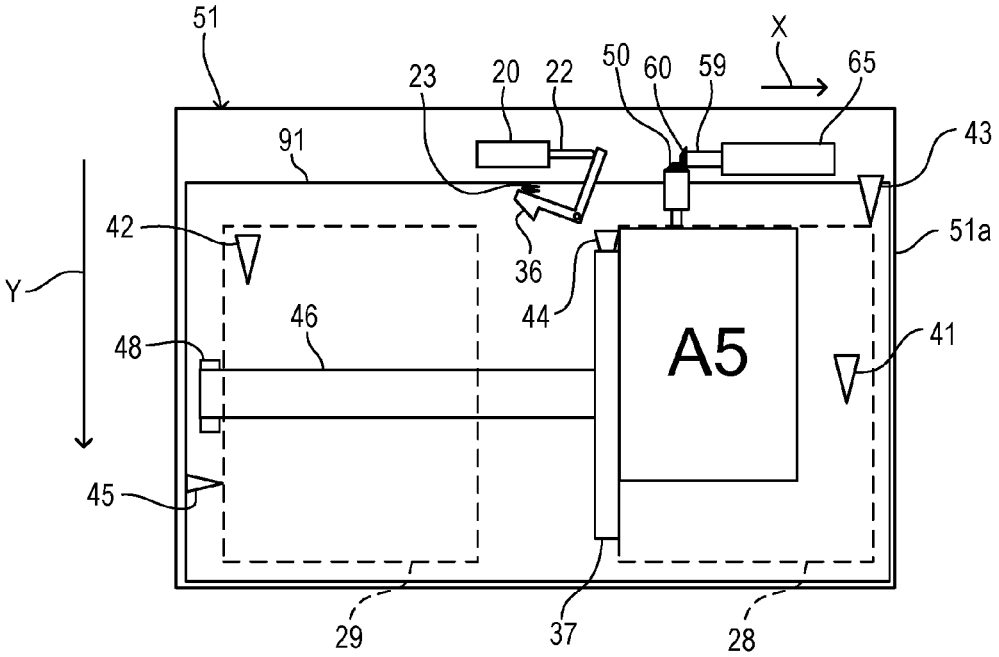

Next, sheet bundle movement controlling operation will be described with reference to FIG. 6, FIG. 7, FIG. 8, FIG. 9A, FIG. 9B, FIG. 9C, FIG. 10A, and FIG. 10B. FIG. 6 is a flow chart for illustrating the sheet bundle movement controlling operation during the image forming operation. FIG. 7 is a flow chart for illustrating the sheet bundle movement controlling operation when the cassette 91 is closed. FIG. 8 is a flow chart for illustrating subroutines of the sheet bundle movement operation. FIG. 9A, FIG. 9B, and FIG. 9C are views for illustrating a screen displayed on a display portion (annunciator) 311 of the UI 330. The display portion 311 comprises a device such as liquid crystal. FIG. 10A and FIG. 10B are explanatory views for illustrating a use case where an A5-size sheet Q different from the A4-size sheet as the predetermined-size sheet is placed.

First, with reference to FIG. 6, description will be made with the sheet bundle movement controlling operation executed during the image forming operation. When the image forming operation is started, the CPU 301 starts the sheet bundle movement controlling operation illustrated in FIG. 6. FIG. 6 is an illustration of the sheet bundle movement controlling operation when the sheets P on the first sheet storage area 28 are used up during the image forming operation. The CPU 301 executes the sheet bundle movement controlling operation in accordance with a program stored in the ROM 302. Based on a detection signal of the third sheet sensor 78, the CPU 301 determines whether or not the sheet P exists on the first sheet storage area 28 (Step S601). When the sheet P exists on the first sheet storage area 28 (YES in Step S601), Step S601 is repeated until the sheets P on the first sheet storage area 28 are used up. When no sheet P exists on the first sheet storage area 28 (NO in Step S601), based on a detection signal of the second sheet sensor 42, the CPU 301 determines whether or not the sheet P exists on the second sheet storage area 29 (Step S602). When no sheet P exists on the second sheet storage area 29 (NO in Step S602), the CPU 301 annunciates a user of out-of-sheet (Step S604). Specifically, for example, as illustrated in FIG. 9A, a screen 901 that displays a message of "Cassette is out of sheet. Please set sheets on cassette.", and an OK button 900 are displayed on the display portion 311 of the UI 330. The CPU 301 finishes the sheet bundle movement controlling operation. The UI 330 includes an input key group 313 to be used when a user inputs information, a start key 306 to be pressed when the image forming operation is started, a stop key 308 to be pressed when the image forming operation is interrupted, and a reset button 335. When the sheet P exists on the second sheet storage area 29 (YES in Step S602), the CPU 301 executes the sheet bundle movement operation (Step S603). The sheet bundle movement operation will be described later with reference to FIG. 8.

Next, with reference to FIG. 7, description will be made with the sheet bundle movement controlling operation when the sheet feeding device 51 is opened and closed at the time image formation is not performed. When the cassette 91 is pulled out from the main body 51*a* of the sheet feeding device 51, the CPU 301 starts the sheet bundle movement controlling operation illustrated in FIG. 7. FIG. 7 is an illustration of the sheet bundle movement controlling operation when the opened cassette 91 is closed at the time image formation is not performed. The CPU 301 executes the sheet bundle movement controlling operation in accordance with the program stored in the ROM 302. Based on a detection signal of the cassette opening and closing sensor 43, the CPU 301 determines whether or not the cassette 91 is closed after the cassette 91 is pulled out from the main body 51*a* of the sheet feeding device 51 (Step S701). When the cassette 91 remains open after pulled out from the main body 51*a* of the sheet feeding device 51 (NO in Step S701), the CPU 301 repeats Step S701 until the cassette 91 is closed. When the cassette 91 is closed (YES in Step S701), based on a detection signal of the first sheet sensor 41, the CPU 301 determines whether or not the sheet P exists on the first sheet storage area 28 (Step S702). When the sheet P exists on the first sheet storage area 28 (YES in Step S702), the CPU 301 finishes the sheet bundle movement controlling operation. When no sheet P exists on the first sheet storage area 28 (NO in Step S702), based on a detection signal of the second sheet sensor 42, the CPU 301 determines whether or not the sheet P exists on the second sheet storage area 29 (Step S703). When no sheet P exists on the second sheet storage area 29 (NO in Step S703), the CPU 301 annunciates a user of out-of-sheet (Step S705). Specifically, for example, as illustrated in FIG. 9A, the screen 901 that displays the message of "Cassette is out of sheet. Please set sheets on cassette.", and the OK button 900 are displayed on the display portion 311 of the UI 330. The CPU 301 finishes the sheet bundle movement controlling operation. When the sheet P exists on the second sheet storage area 29 (YES in Step S703), the CPU 301 executes the sheet bundle movement operation (Step S704). The sheet bundle movement operation will be described later with reference to FIG. 8.

The cassette 91 according to the embodiment has such a configuration that the first sheet storage area 28 and the second sheet storage area 29 are pulled out integrally. Therefore, as compared to a configuration in which the storage areas can be pulled out individually, the number of components such as a pullout guide can be reduced, thereby obtaining a significant advantage in cost. However, there is a fear in that a user may store a sheet having a size different from the predetermined size (A4 size or letter size) in the cassette 91 pulled out as illustrated in FIG. 5B. Accordingly, when the bundle movement regulating plate 37 is not moved normally, it is conceivable that the sheet having the size different from the predetermined size may be placed on the cassette 91 besides that there may be an abnormality in the sheet bundle moving device. Thus, according to the embodiment, during the sheet bundle movement controlling operation, the image forming apparatus annunciates a user of a difference in size when there is a high possibility that the sheet having the size different from the predetermined size is placed on the cassette 91, whereas the image forming apparatus annunciates the user of an abnormality of the cassette when there is a high possibility that there is the abnormality in the sheet bundle moving device.

Now, with reference to FIG. 8, subroutines of the sheet bundle movement operation will be described. When the sheet bundle movement operation is started in Step S603 or Step S704, the CPU 301 starts forward rotation of the plate driving motor 65 (Step S801). The plate driving motor 65 starts movement of the bundle movement regulating plate 37 so that the sheet bundle P stored on the second sheet storage area 29 is started to move to the first sheet storage area 28. The CPU 301 initializes the variable "t" stored in the RAM 303 to zero, and starts the timer 291 (Step S802). When the timer 291 is started, the CPU 301 measures the elapsed time period while counting up the variable "t". The CPU 301 determines whether or not the detection signal of the plate sensor 44, which indicates that the bundle movement regulating plate 37 reaches the plate sensor 44, has been received (Step S803). When the detection signal of the plate sensor 44 has not been received (NO in Step S803), the CPU 301 determines whether or not the variable "t" counted up by the timer 291 is larger than a threshold value (first predetermined time period) T1 preset in the RAM 303 (Step S812).

When the variable is larger than the threshold value T1 (YES in Step S812), the CPU 301 annunciates a user of the abnormality of the cassette (Step S813). Because the bundle movement regulating plate 37 does not reach the plate sensor 44 within a predetermined time period, it is conceivable that there may be the abnormality in the cassette 91.

Specifically, as illustrated in FIG. 9C, a screen 903 that displays a message of "There is abnormality in cassette. Please call for service man.", and the OK button 900 are displayed on the display portion 311 of the UI 330. Because the bundle movement regulating plate 37 does not reach the plate sensor 44 even after the predetermined time period has elapsed from start of movement of the bundle movement regulating plate 37, it is assumed that some malfunction occurs in the cassette 91 or the sheet feeding device 51. In this manner, it is possible to call a user to check the cassette 91. The CPU 301 stops drive of the plate driving motor 65 (Step S811), and finishes the sheet bundle movement operation. The plate sensor 44 and the CPU 301 function as the determination unit configured to determine whether or not movement of the sheet bundle P from the second sheet storage area 29 to the first sheet storage area 28 is completed. When the variable "t" is not larger than the threshold value T1 (NO in Step S812), processing is returned to Step S803. When the detection signal of the plate sensor 44 is received (YES in Step S803), the CPU 301 stops drive of the plate driving motor 65 (Step S804). In this manner, movement of the sheet bundle P from the second sheet storage area 29 to the first sheet storage area 28 is completed.

The CPU 301 determines whether or not the first sheet sensor 41 mounted in the first sheet storage area 28 has detected the sheet P (Step S805). When the first sheet sensor 41 detects the sheet P (YES in Step S805), the CPU 301 clears a variable "A" stored in the RAM 303 to zero (Step S806). The variable "A" indicates the number of times of occurrence of an abnormality during the sheet bundle movement operation. Then, the processing proceeds to Step S807. Meanwhile, when the first sheet sensor 41 does not detect the sheet P (NO in Step S805), the CPU 301 adds one to the variable "A" (Step S815). That is, the CPU 301 functions as a counter configured to count the number of times that the first sheet sensor 41 does not detect the sheet P after the bundle movement regulating plate 37 completes movement operation of the sheet P from the second sheet storage area 29 to the first sheet storage area 28. The CPU 301 determines whether or not the variable "A" is larger than a threshold value (the predetermined number of times) N preset in the RAM 303 (Step S816). When the variable "A" is not larger than the threshold value N (NO in Step S816), the CPU 301 annunciates a user of the difference in size (Step S818). Specifically, for example, as illustrated in FIG. 9B, a screen 902 that displays a message of "There is possibility that sheet of out-of-size-specification is set. Please check it out.", and the OK button 900 are displayed on the display portion 311 of the UI 330. When the first sheet sensor 41 does not detect the sheet P moved by the bundle movement regulating plate 37 from the second sheet storage area 29 to the first sheet storage area 28, there is a possibility that a size of the sheet P is smaller than the predetermined size (A4 size or letter size). Then, the processing proceeds to Step S807.

Now, with reference to FIG. 10A and FIG. 10B, description will be made with a use case that may arise when the difference in size is annunciated in Step S818. FIG. 10A and FIG. 10B are explanatory views for illustrating a use case where an A5-size sheet bundle Q is placed on the second sheet storage area 29. The A5-size sheet Q is a sheet smaller than and different from the predetermined-size (A4-size or letter-size) sheet. FIG. 10A is a view for illustrating a state in which the A5-size sheet bundle Q smaller than the A4-size sheet in dimension in the direction Y orthogonal to the sheet feeding direction X is placed on the second sheet storage area 29 (Long-edge setting of the A5-size sheets). At this time, the second sheet sensor 42 detects the sheets Q, whereas the first sheet sensor 41 does not detect the sheets Q. Accordingly, the sheet bundle movement operation can be executed (Step S603 or Step S704). The sheet bundle Q placed on the second sheet storage area 29 is moved by the bundle movement regulating plate 37 to the first sheet storage area 28. When the bundle movement regulating plate 37 reaches the plate sensor 44, the plate sensor 44 outputs the detection signal. FIG. 10B is a view for illustrating a state in which the CPU 301 has received the detection signal of the plate sensor 44 (YES in Step S803), and then stops drive of the plate driving motor 65 (Step S804). As illustrated in FIG. 10B, the first sheet sensor 41 cannot detect the A5-size sheet bundle Q (NO in Step S805). As described above, when the first sheet sensor 41 cannot detect the sheet bundle Q (NO in Step S805), it is likely that a user has placed the sheet having the size different from the predetermined size on the second sheet storage area 29. Accordingly, when the variable "A" is not larger than the threshold value N (NO in Step S816), not the abnormality of the cassette but the difference in size is annunciated in Step S818, thereby calling a user to check the size of the sheet.

Meanwhile, when the variable "A" is larger than the threshold value N (YES in Step S816), the CPU 301 annunciates the abnormality of the cassette (Step S817). Specifically, as illustrated in FIG. 9C, the screen 903 that displays the message of "There is abnormality in cassette. Please call for service man.", and the OK button 900 are displayed on the display portion 311 of the UI 330. When the variable "A" is larger than the threshold value N, although a user properly stores the predetermined-size sheet P in the cassette 91 in accordance with information of the difference in size annunciated in Step S818, the first sheet sensor 41 cannot detect the sheet P after the sheet bundle movement operation. In this case, it is assumed that some malfunction occurs in the cassette 91 or the sheet feeding device 51. The processing proceeds to Step S807.

The CPU 301 starts reverse rotation of the plate driving motor 65 (Step S807). This is performed in order that the bundle movement regulating plate 37 having been moved to the plate sensor 44 is returned to the home position HP1. The CPU 301 initializes the variable "t" stored in the RAM 303 to zero, and starts the timer 291 (Step S808). When the timer 291 is started, the CPU 301 measures the elapsed time period while counting up the variable "t". The CPU 301 determines whether or not the detection signal of the plate HP sensor 45, which indicates that the bundle movement regulating plate 37 reaches the plate HP sensor 45, has been received (Step S809). When the detection signal of the plate HP sensor 45 is not received (NO in Step S809), the CPU 301 determines whether or not the variable "t" counted up by the timer 291 is larger than a threshold value (second predetermined time period) T2 preset in the RAM 303 (Step S810).

When the variable is larger than the threshold value T2 (YES in Step S810), the CPU 301 annunciates the abnormality of the cassette (Step S813). Specifically, as illustrated in FIG. 9C, the screen 903 that displays the message of "There is abnormality in cassette. Please call for service man.", and the OK button 900 are displayed on the display portion 311 of the UI 330. Because the bundle movement regulating plate 37 does not reach the plate HP sensor 45 even after the predetermined time period has elapsed from start of movement of the bundle movement regulating plate 37, it is assumed that some malfunction occurs in the cassette 91 or the sheet feeding device 51. In this manner, it is possible to call a user to check the cassette 91. The CPU 301 stops drive of the plate driving motor 65 (Step S811), and finishes the sheet bundle movement operation. When the variable "t" is not larger than the threshold value T2 (NO in Step S810), the processing returns to Step S809. When the detection signal of the plate HP sensor 45 is received (YES in Step S809), the CPU 301 stops drive of the plate driving motor (Step S811). The plate driving motor 65 completes return of the bundle movement regulating plate 37 to the home position HP1. The CPU 301 finishes the sheet bundle movement operation.

As described above, according to the embodiment, when the first sheet sensor 41 does not detect the sheet P despite the fact that the bundle movement regulating plate 37 is moved properly, a proper message is annunciated to a user, thereby calling a user to cope with the situation properly. For example, when a user places the sheet Q having a size (such as an A5 size or a B5R size) smaller than the predetermined size on the cassette 91, the CPU 301 can annunciate the difference in size in Step S818. Further, for example, when the first sheet sensor 41 does not detect the sheet P after finish of the sheet bundle movement operation despite the fact that a user places the predetermined-size sheet P on the cassette 91, it is assumed that a malfunction may occur in the first sheet sensor 41. In this case, the CPU 301 can annunciate the abnormality of the cassette in Step S817. In the embodiment, in accordance with the number of times that the first sheet sensor 41 does not detect the sheet P after the completion of the sheet bundle movement operation, it is possible to properly annunciate a user whether the problem is the difference in sheet size or the malfunction of the cassette 91. Specifically, when the number of times that the sheet P cannot be detected (the number of times that out-of-sheet is detected) is equal to or smaller than the predetermined number of times, it is annunciated that the size of the sheet placed on the cassette 91 is different from the predetermined size. When the number of times that the sheet P cannot be detected (the number of times that out-of-sheet is detected) is larger than the predetermined number of times, the abnormality of the cassette 91 is annunciated. Thus, reduction in usability can be prevented.

According to the embodiment, when there is an abnormality during the sheet bundle movement operation, it can be annunciated that the sheet Q having the size different from the predetermined size is placed on the cassette 91. Further, when the number of times that there is the abnormality during the sheet bundle movement operation exceeds the predetermined number of times, the abnormality of the cassette 91 can be annunciated.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-176703, filed Sep. 8, 2015, which is hereby incorporated by reference herein in its entirety.

What is claimed is:

1. An image forming apparatus, comprising:

a cassette comprising a first sheet storage area and a second sheet storage area, arranged side by side, each on which a sheet having a predetermined size is placeable;

an image forming portion configured to form an image on the sheet;

a sheet feeder configured to feed the sheet placed on the first sheet storage area of the cassette to the image forming portion;

a first sheet sensor configured to detect the sheet placed on the first sheet storage area;

a second sheet sensor configured to detect the sheet placed on the second sheet storage area;

a movement member configured to move the sheet from the second sheet storage area to the first sheet storage area when the sheet is not detected by the first sheet sensor and the sheet is detected by the second sheet sensor; and an annunciator configured to annunciate that a sheet having a size different from the predetermined size is placed on the cassette in a case where the first sheet sensor does not detect the sheet on the first sheet storage area after a completion of a movement operation of the sheet from the second sheet storage area to the first sheet storage area by the movement member.

2. An image forming apparatus according to claim 1, further comprising a counter configured to count a number of times of occurrence of the case where the first sheet sensor does not detect the sheet on the first sheet storage area after the completion of the movement operation of the sheet from the second sheet storage area to the first sheet storage area by the movement member, wherein the annunciator is configured to annunciate that the sheet having the size different from the predetermined size is placed on the cassette when the first sheet sensor does not detect the sheet on the first sheet storage area after the completion of the movement operation and when a count value of the counter is not larger than a predetermined threshold value.

3. An image forming apparatus according to claim 2, wherein the annunciator is configured to annunciate that there is an abnormality in the cassette when the first sheet sensor does not detect the sheet on the first sheet storage area after the completion of the movement operation and when the count value of the counter is larger than the predetermined threshold value.

4. An image forming apparatus according to claim 1, further comprising:

a movement member sensor configured to output a first detection signal indicating that the movement member reaches a predetermined position at which a movement of the sheet from the second sheet storage area to the first sheet storage area is completed; and a movement member home position sensor configured to output a second detection signal indicating that the movement member is returned to a home position, wherein the annunciator is configured to annunciate that there is an abnormality in the cassette when the movement member sensor does not output the first detection signal even after a first predetermined time period has elapsed from a start of a movement of the movement member from the home position to the predetermined position, and wherein the annunciator is configured to annunciate that there is an abnormality in the cassette when the movement member home position sensor does not output the second detection signal even after a second predetermined time period has elapsed from a start of a return of the movement member from the predetermined position to the home position.

5. An image forming apparatus according to claim 1, wherein the movement member is configured to move the sheet from the second sheet storage area to the first sheet storage area when no sheet exists on the first sheet storage area and the sheet exists on the second sheet storage area in an image forming operation.

6. An image forming apparatus according to claim 1, further comprising a cassette supporting member configured to support the cassette so that the cassette is movable between a pullout position at which the cassette is pulled out from a main body of the image forming apparatus and a mounting position at which the cassette is mounted to the main body of the image forming apparatus.

7. An image forming apparatus according to claim 6, wherein the movement member is configured to move the sheet from the second sheet storage area to the first sheet storage area in a case where no sheet exists on the first sheet storage area and the sheet exists on the second sheet storage area when the pulled-out cassette is mounted at the mounting position.

* * * * *